US009881593B2

(12) United States Patent
Edwards

(10) Patent No.: US 9,881,593 B2
(45) Date of Patent: Jan. 30, 2018

(54) MODULAR ADJUSTABLE FRETBOARD APPARATUS

(71) Applicant: William Edwards, Tampa, FL (US)

(72) Inventor: William Edwards, Tampa, FL (US)

( * ) Notice: Subject to any disclaimer, the term of this patent is extended or adjusted under 35 U.S.C. 154(b) by 0 days.

(21) Appl. No.: 15/344,954

(22) Filed: Nov. 7, 2016

(65) Prior Publication Data

US 2017/0124991 A1 May 4, 2017

Related U.S. Application Data

(63) Continuation-in-part of application No. 14/930,621, filed on Nov. 2, 2015, now Pat. No. 9,520,109.

(51) Int. Cl.
*G10D 1/08* (2006.01)
*G10D 3/06* (2006.01)

(52) U.S. Cl.
CPC ..... *G10D 3/06* (2013.01); *G10D 1/08* (2013.01)

(58) Field of Classification Search
CPC ..... G10D 3/06
USPC ..... 84/314 R
See application file for complete search history.

(56) References Cited

U.S. PATENT DOCUMENTS 4,221,151 A * 9/1980 Barth ..... G10D 3/06 84/293
4,777,858 A * 10/1988 Petschulat ..... G10D 3/06 84/314 R
6,452,081 B1 * 9/2002 Ravagni ..... G09B 15/023 84/464 A
6,911,590 B2 * 6/2005 Childress ..... G10D 1/00 84/291
9,082,385 B2 * 7/2015 Rubman ..... G10H 3/181

* cited by examiner

*Primary Examiner* — Jianchun Qin

(57) ABSTRACT

A modular apparatus and method of varying the playability and tonal characteristics of a stringed instrument such as an acoustic or electric guitar which is commonly provided with a body and a fretboard to the instrument's neck. The modular apparatus includes a longitudinal rail, accessible fasteners, intermediary spacer blocks and a plurality of adjustable and removable frets. The rail is configured to connect with the neck of the stringed instrument and to provide a base for the frets. The frets are configured to move as needed within apertures within the rail. The frets are also configured to receive and support the instrument's strings. The frets are selectively adjustable relative to the rail by the user to change the tonal and playability characteristics of the instrument.

6 Claims, 13 Drawing Sheets

MODULAR ADJUSTABLE FRETBOARD APPARATUS

CROSS REFERENCE TO RELATED APPLICATIONS

This application is a Continuation in Part of U.S. patent application Ser. No. 14/930,621, filed Nov. 2, 2015, which application is incorporated by reference as though fully contained herein.

FIELD OF THE INVENTION

The present invention relates generally to frets and fretboards for stringed musical instruments, and in a particular though non-limiting embodiment, to a fretboard and frets for a guitar which are capable of being adjusted and modified in a more time-efficient, cost-effective, precise, and non-destructive manner

BACKGROUND OF THE INVENTION

FIG. 1 shows a prior art musical instrument 100. The musical instrument 100 shown in FIG. 1 is a six stringed electrical guitar. The musical instrument 100 shown in FIG. 1 includes a body 112, a neck 114 extending from the body 112 and a nut 116 extending transversely across the neck 114. A headstock 124 extends from the neck 114, and is shown in FIG. 1. The stringed musical instrument 100 also includes a bridge 118. A plurality of strings 120 is supported between the nut 116 and the bridge 118. FIG. 1 also shows a plurality of frets 122 extending perpendicular across the neck 114. FIG. 2 is an enlarged view of a portion of the neck 114 of the instrument 100 shown in FIG. 1. FIG. 3 is a larger view of a smaller portion of the neck 114 shown in FIG. 2 to more clearly show orientation of the frets 122.

As shown in FIG. 1, conventional stringed musical instruments are typically equipped with a neck or fingerboard which is used to control the length, and therefore the vibrational frequency of the strings 120 being plucked, strummed, bowed, or otherwise activated.

In the conventional fretted stringed musical instrument, the string length is achieved through the fingers of the fretting hand pressing them against pieces of wire, the fret 122, imbedded in slots in the fingerboard. The string, being pressed against the hard surface of the fret 122 and thereby stopped, is effectively shortened by the amount of distance of the fret to the bridge 118, which defines the effective vibrating length of the string, thus altering its pitch (or 'frequency of vibration').

As shown in FIG. 4, representations of typical frets 122 are shown, enlarged for clarity, with respect to the fingerboard. In conventional fretted stringed instruments, these frets 122 are wires of a general "T" cross-sectional shape, with the vertical base or tang 122*a* equipped with barbs 122*b* and the horizontal top or "crown" 122*c* being a more or less hemispherical shape. The tang 122*a* is pressed into an imbedding slot cut into the fingerboard, where the tang's barbs 122*b* embed into the walls of the embedding slot, presumably fixing the fret 122 within the fingerboard. The domed crown 122*d* is thus seated against the surface of the fingerboard, where its hemispherical cross-section produces a convenient "stop" against which the string can be firmly and comfortably pressed by the fingers of the player's hand.

These frets as shown in FIGS. 1 through 4 are generally fixed so that their function can be reliable. They are removed only with great difficulty when they are so worn by use or become loosened that they must be replaced with new frets in order to play the instrument accurately and precisely. Removal of the frets is difficult because the barbs 122*b* tear through the wood of the fingerboard. The damaged wood cannot be restored and the gouges in the wood from the fret barbs or "tangs" cannot be effectively repaired per se. When the frets are replaced, they typically need to be glued-in, which makes the next replacement procedure even more difficult. This refretting operation can easily cost hundreds of dollars, takes a skilled luthier or repairman, and is time consuming In addition, because the frets are essentially immovable without time, repair, and expense, they cannot be removed and replaced at the fancy of a musician desiring to experiment with different implementations.

SUMMARY OF INVENTION

In a first embodiment, the invention includes a removable fret assembly for a fretted stringed musical instrument. The assembly includes an elongated rail having a first end and a second end as well as an upper surface and a lower surface. A plurality of bores extend from the upper surface of the rail to the lower surface defining a channel therein. At least one fret having a longitudinal body and a spine depending therefrom is movably disposed within at least one of the bores on the upper surface of the rail. A mechanical adjustment device, such as a screw, moves within the channel and is accessible through the lower surface of the rail and is in contact with the spine of the fret. Movement of the mechanical adjustment device causes the fret to move in distal relation, toward or away, to the rail.

A bore disposed in a side of the rail extending inward and in communication with the channel houses a mechanical locking screw. The locking screw is movably disposed within the side bore and engages in releasable contact with the spine of the fret, thereby holding it in position.

In another embodiment, the invention includes another plurality of bores extending from the upper surface of the rail to the lower surface. Each of these bores are placed in between the channels that receive the frets. These second class of bores are used to receive mechanical fasteners which hold spacer blocks between the frets to give the appearance of a traditional fretboard.

In a preferred embodiment, the fret bores and the spines of the frets have matching geometries, such as a square, rectangle, cylinder, hexagon, triangle, D-shape, keyways, oblong or other appropriate shape. This prevents rotational movement of the fret in the channel.

In addition to the downward facing spine, the fret can also include a first flange and/or second downward facing flange on opposite ends of the fret body to provide stability and prevent rocking of the fret.

In yet another embodiment, the elongated rail further comprises a recess at the head end thereof. This recess engages a nut platform fastener assembly having a neck portion and a head portion. The neck portion of the nut assembly is mechanically fixed in overlying relation to the recess at the first end of the rail. The head portion of the nut assembly is affixed to the headstock of the stringed instrument by mechanical fasteners.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

The device will now be described with reference to the accompanying Figures. In all Figures, like numerals correspond to like elements. The device is directed to an apparatus and method for selectively modifying the tonal character of an acoustic or electric stringed instrument using an adjustable fret assembly. One suitable embodiment of an adjustable fret assembly, generally designated 10, is illustrated in FIGS. 5-10. Specific details of the device and its use are disclosed more completely below.

By way of background, the term "stringed instrument" is intended to be directed to a wide variety of stringed instruments. Suitable, non-limiting examples include the acoustic guitar, electric guitar, acoustic bass guitar and electric bass guitar, banjo, mandolin, and similar type instruments. Although the Figures depict a six stringed instrument with twenty-one frets, the scope of this disclosure includes instruments with more or fewer strings and/or frets.

Figure 1:
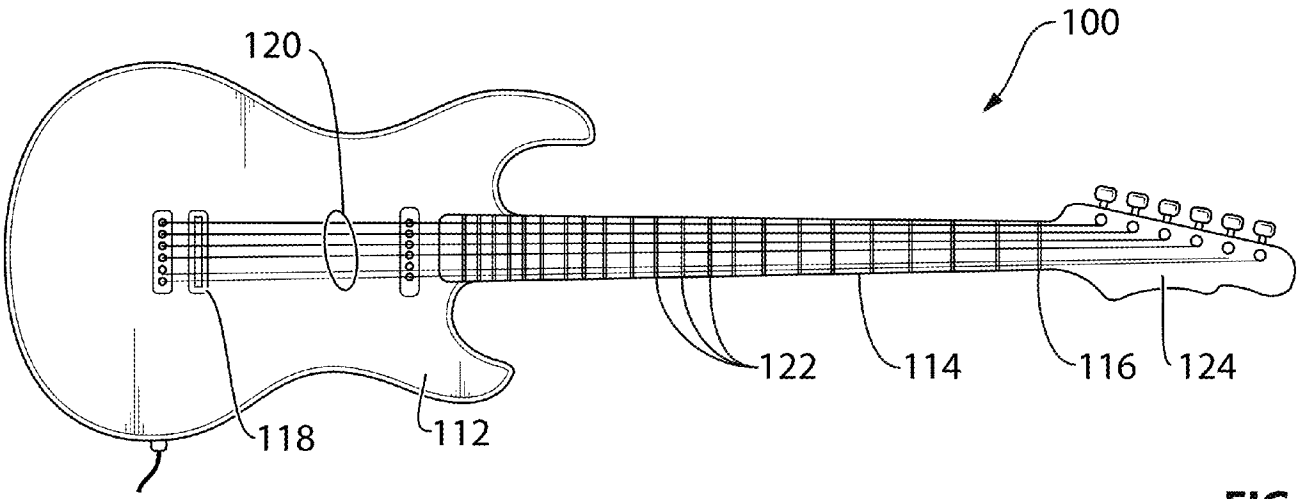
FIG. 1 PRIOR ART
FIG. 1 is a plan view of a prior art stringed instrument.
Figure 2:
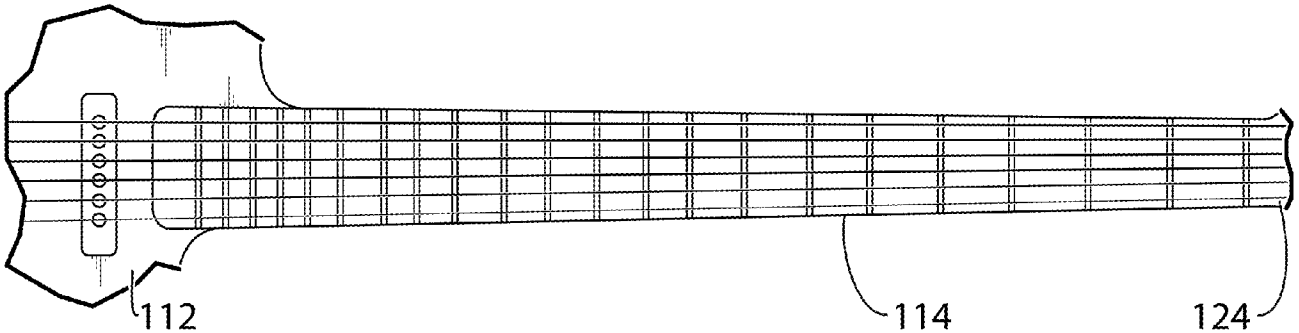
FIG. 2 PRIOR ART
FIG. 2 is an enlarged view of the neck of the instrument shown in FIG. 1.
Figure 4:
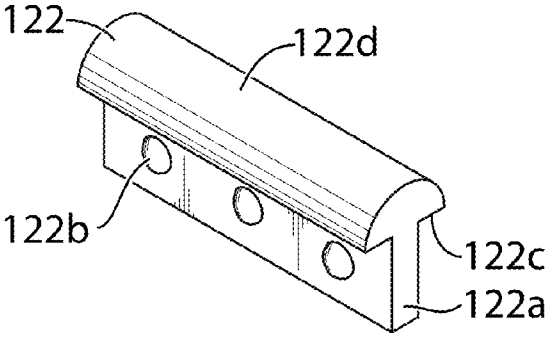
FIG. 4 PRIOR ART
FIG. 4 is a perspective view of a prior art fret.
Figure 3:
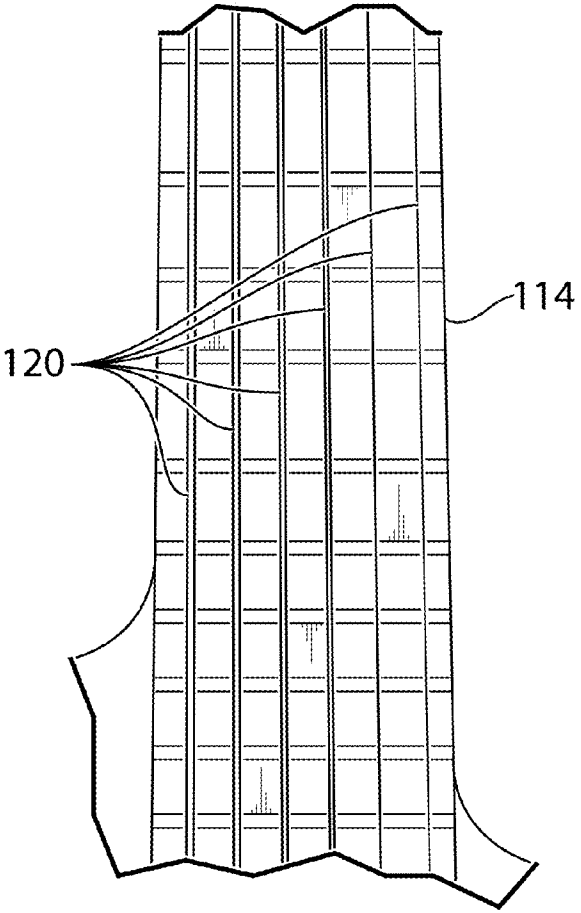
FIG. 3 PRIOR ART
FIG. 3 is an enlarged view of a portion of the neck shown in FIG. 2.
Figure 5:
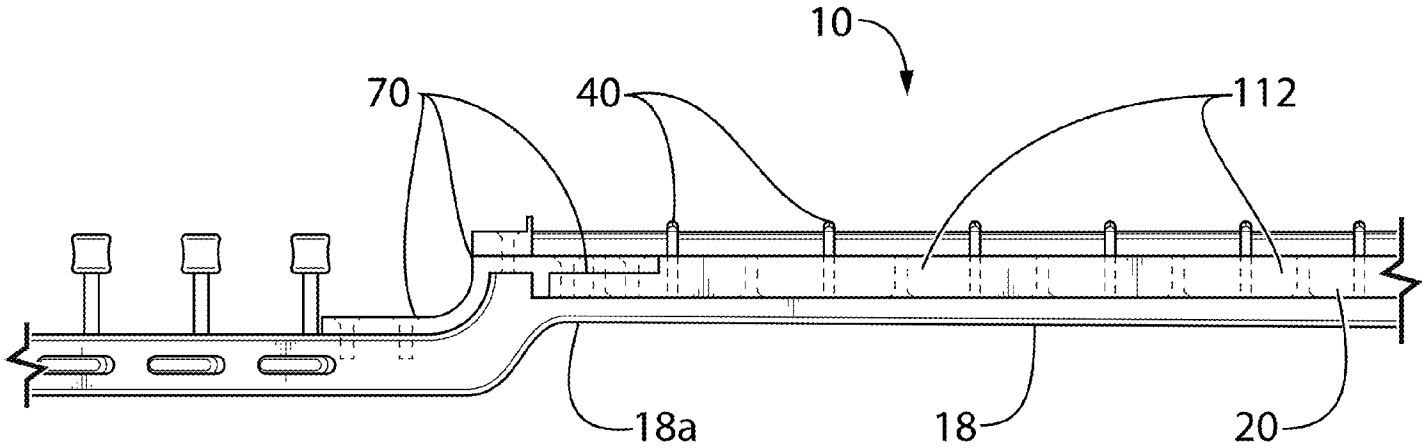
FIG. 5 is an enlarged view of a portion of the neck and head of a stringed instrument comprising an embodiment of the adjustable fret assembly.

Referring now to the drawings in which like reference characters refer to like or similar parts throughout the several views, there are shown in FIG. 5 various features of a system 10 for a fretted, stringed musical instrument according to a preferred form of the present invention. It is first noted that details of the other components of the musical instrument such as the strings, tuning keys, sound box, and bridge may be omitted from some views for the purposes of clarity, but are well known in the art to which the present invention pertains. Thus, it will be understood that reference to such components, even if not shown in the drawings, is intended to refer to such components of a conventional type. Moreover, while for the purpose of describing various aspects of the system 10 a guitar-type configuration is shown, it will be understood that the present invention is equally well suited for use with all fretted, stringed, musical instruments such as bass guitars, banjos, ukuleles, dulcimers, mandolins and the like.

Figure 6:
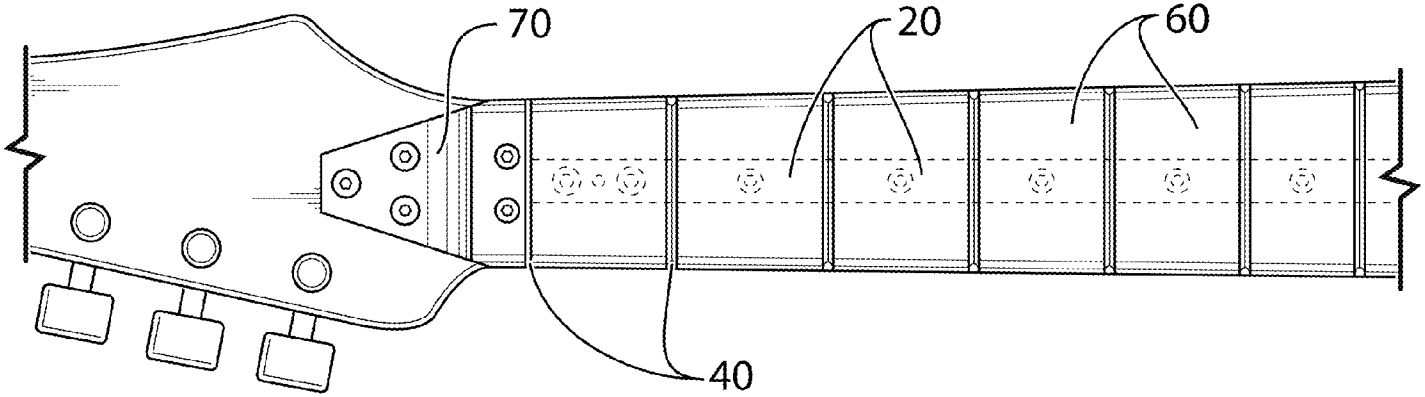
FIG. 6 is a top plan view of the adjustable fret assembly.

Referring to FIGS. 5 and 6, assembly 10 includes a plurality of frets 40. A neck body 18 having a head end and a heel end receives a fret rail 20 within a longitudinal groove formed in a flat upper surface thereof. Rail 20 lies in a plane below the placement of a traditional fingerboard. It may be appreciated that the neck of a stringed instrument may suffer reduced ability to withstand bending forces imposed on it because of the removal of material in this region. These forces are normally resisted through the thickness of the neck or the insertion of a reinforcing truss during manufacture. To compensate, rail 20 can be constructed from a rigid material sufficient to resist these bending forces. Changes in overall neck geometry resulting from changes in string tensions by going from higher or lower gauge strings can be directly compensated by adjustments to the individual frets and thus the overall fret plane."

Rail 20 includes numerous apertures for receiving frets 40 as well as spacer blocks 60 positioned between the frets to give the appearance of a traditional fingerboard. Rail 20 is preferably fixedly mounted to the neck body 18 and the frets 40 are movably connected to rail 20 to permit up and down movement of the frets 40 in rail 20, toward and away from neck body 18. A plurality of adjustment screws (25) are provided for moving frets 40 up and down.

Figure 7:
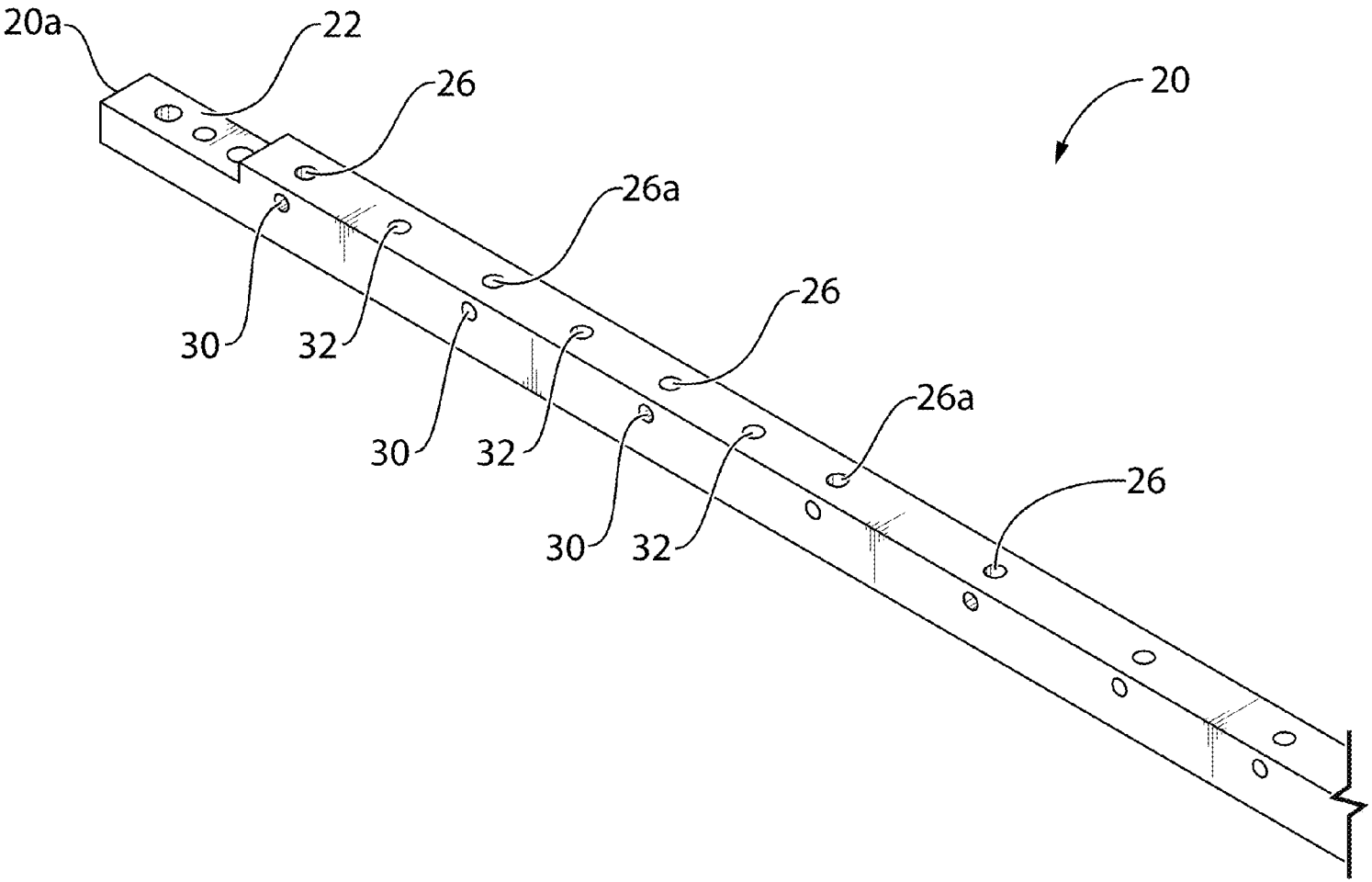
FIG. 7 is an isometric view of the head portion of the fret rail.
Figure 8:
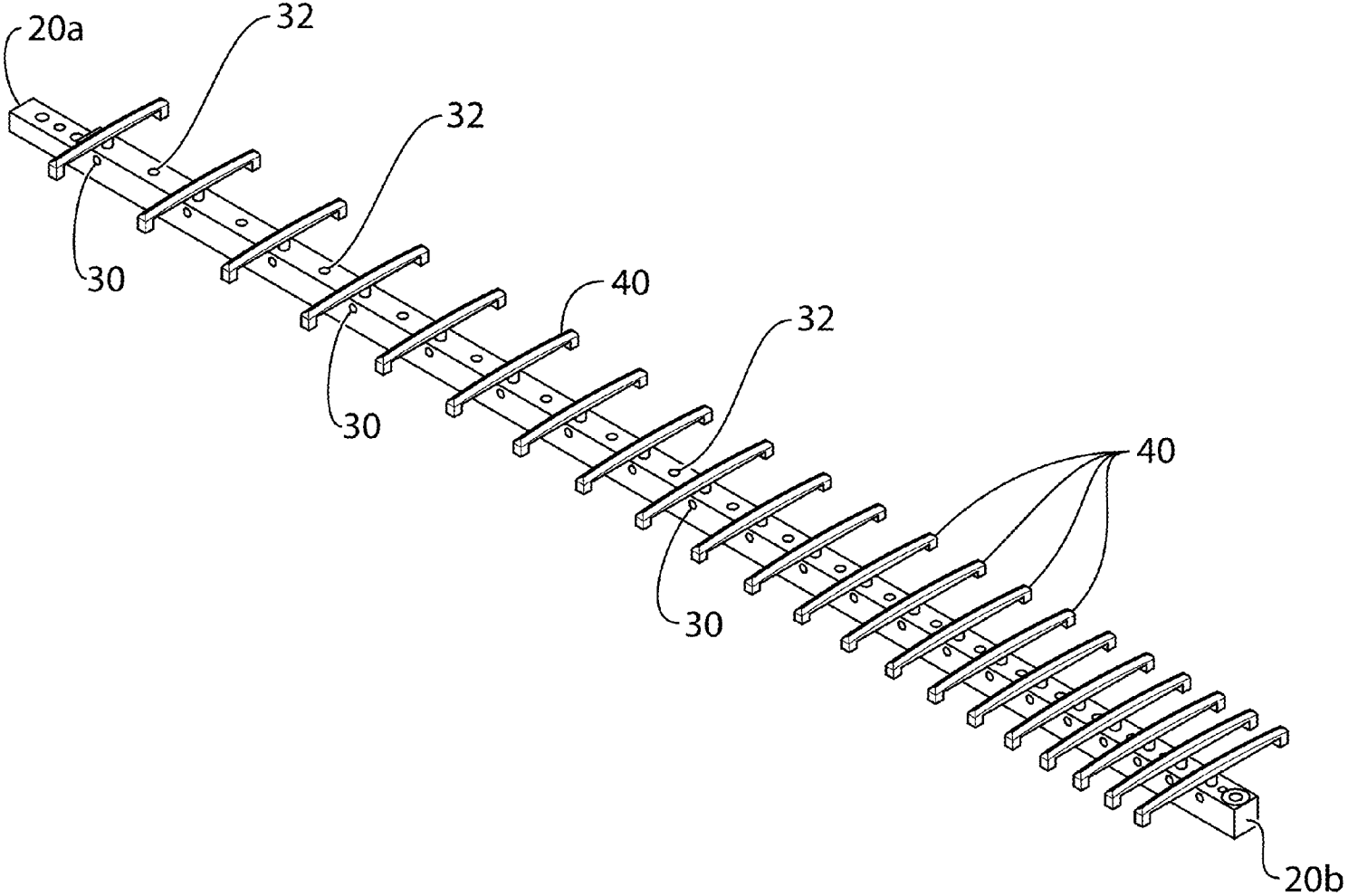
FIG. 8 is an isometric view of the fret rail with installed adjustable frets.
Figure 9:
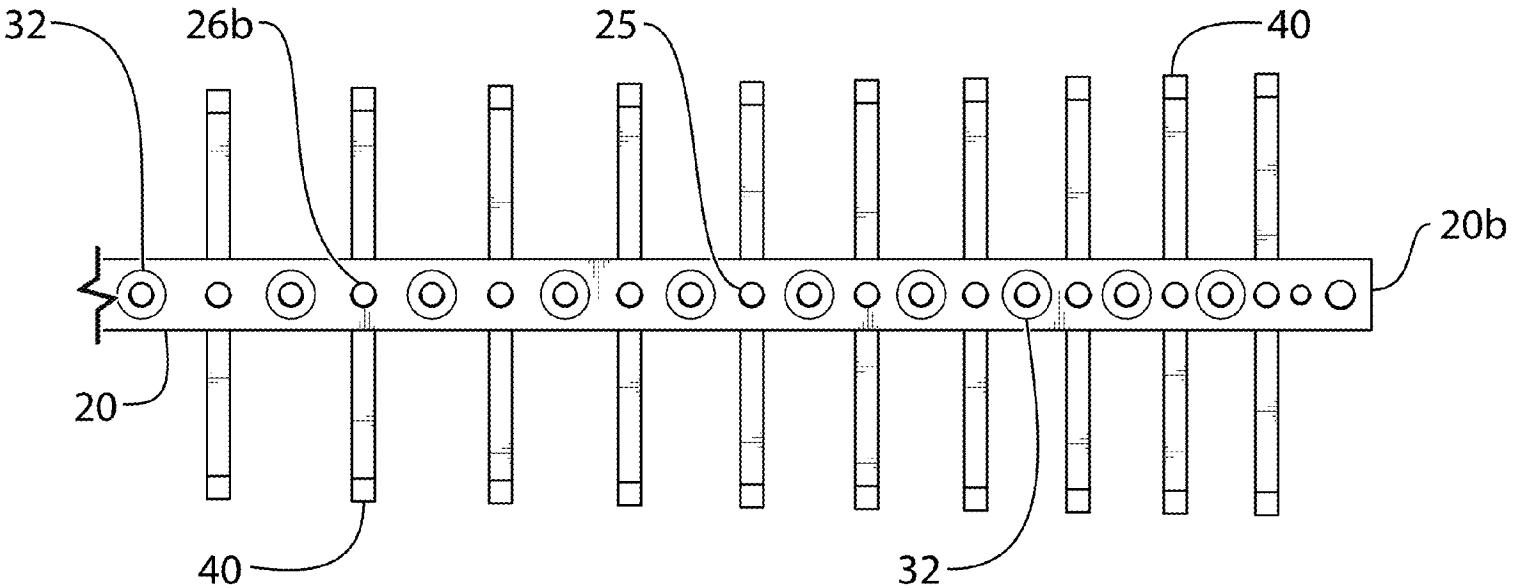
FIG. 9 is a bottom plan view of the heel portion of the fret rail with installed adjustable frets.

With specific reference to FIGS. 7-9, rail 20 of the adjustable fret assembly 10 is depicted. As shown, rail 20 is a substantially elongated element having a head end 20*a* and a heel end 20*b*. Head end 20*a* has a recessed attachment plate 22 for connection to a nut platform and fastener assembly (discussed below). Rail 20 is generally configured to form a base element for the adjustable fret assembly 10.

A plurality of fret holes 26 extend through rail 20 from its upper to lower surfaces. In a preferred embodiment, as shown in the drawings, fret holes 26*a* in the upper surface of rail 20 are substantially square to receive a portion of a fret (40) as described in greater detail below. Fret hole 26*b*, disposed in the lower surface of rail 20, receives an adjustment screw (not shown). The manipulation of the adjustment screw causes the fret (40) to move within fret hole 26 to or away from rail 20.

Corresponding to each fret hole 26 is a lock screw hole 30 preferably disposed in a side of rail 20 and in communication with the aperture connecting upper fret hole 26*a* and lower fret hole 26*b*. A lock screw (31), positioned within lock screw hole 30, frictionally engages a portion of the fret in fret hole 26 and prevents the movement thereof during use of the instrument.

Rail 20 also includes spacer attachment holes 32 which extend from the upper surface to the lower surface thereof. Spacer attachment holes are used to connect spacer blocks 60 (discussed below) to rail 20. Any mechanical fastener can be used to extend through rail 20 and engage the spacer blocks, thereby holding them in place between frets 40.

In use, rail 20 rests in a channel in the neck of a stringed instrument at a desired location best seen in FIGS. 5 and 6. In an embodiment, rail 20 includes at least one fastener bore extending there through to enable it to be fixedly attached to the neck of an instrument. Suitable fasteners include, without limitation, screws or the like. Similarly, adhesives or other known fastening means may also be incorporated without exceeding the spirit and scope of this disclosure. In an alternative embodiment, rail 20 does not include a fastener bore. In such instances the adjustable fret assembly 10 is held in place by the frictional forces exerted by the longitudinal groove in the neck. In this manner, the adjustable fret assembly 10 may be removed easily and without harm to the instrument fret board or neck.

Figure 10:
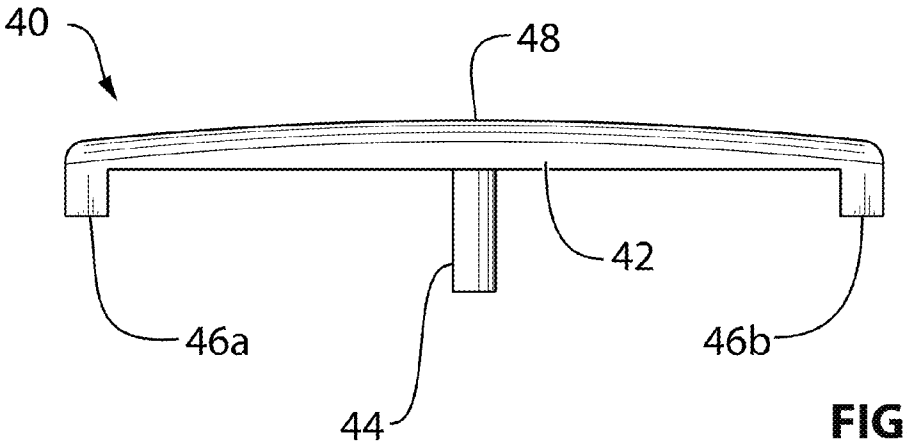
FIG. 10 is a planar view of a fret for use with adjustable fret assembly.

As best seen in FIGS. 8-10, adjustable fret assembly 10 also includes a plurality of adjustable frets 40. Each adjustable fret 40 has a substantially T-shaped longitudinal-section. Fret 40 includes fret support 42 from which depends adjustment spine 44 and opposed first flange 46*a* and second flange 46*b*. Fret cap 48 lies in overlying relation to support 42 and provides the surface for string engagement. Spine 44 is configured to engage and, when in use, be positioned within fret hole 26. As shown in this embodiment, spine 44 and fret hole 26*a* have a substantially square shape. While any shape is contemplated, the shape of the preferred embodiment is such to prevent rotational movement of spine 44 within fret hole 26*a*. It will be appreciated that the tolerance between the spine 44 and fret 26*a* will be such that spine 44 may be inserted and removed into fret hole 26*a* as needed. However, once inserted, the tolerance between the two pieces will be such that any non-user activated movement between spine 44 and fret hole 26*a* is minimized or otherwise prevented.

Spacer blocks 60 are positioned between frets 40 in overlying relation to rail 20. Spacer blocks 60 comprise solid materials, such as veneers, castings, and/or slotted overlays but do not support frets 40. In certain embodiments, the blocks 60 comprise a wide variety of materials, providing a range of possibilities from merely providing a natural wooden mask to cover the rigid fret-rail assembly for a traditional look and feel, to highly reflective 'flashy' metal finishes, to electric and electronic means of producing lighting and effects, such as mirrors, video screens, LEDs, fiber optics, light boards, LCDs, back-lighting, lasers, stained glass, etc., as a means of enhancing showmanship, aiding education, selling advertising, etc., all the while providing the player with an optimal feel for the fretting hand by means of smooth, precise tapering of the join at the corners and edges where each component part meets. Spacer blocks 60 allow for a choice of "feels" from the "fret-less wonder" tiny crowned frets where only a small fraction of the fret tip extends atop the overlay, to the appearance of a "scalloped" fretboard, where the frets extend above the covering so much that no material between the frets is ever felt by the player's fingers, and bends across the frets become virtually frictionless.

In operation, rail 20 is attached to the neck body. In one example, screws are driven through the fastener bores of rail 20 into neck body 18. Alternatively, as shown in FIG. 5, rail 20 is held in place by nut platform 70 which is connected to attachment plate 22 on head end 20*a* of rail 20. In this manner, removal of nut platform 70, affixed to the head of the instrument by mechanical fasteners, allows rail 20 to be lifted out of the channel in the instrument neck body.

Frets 40 are positioned such that spine 44 is inserted into fret hole 26*a*. Frets 40 are held relative to rail 20 via adjustment screws (25) passing through fret holes 26*b* and into rail 20. Adjustment screws 25 allow for very controlled user-activated relative movement between rail 20, fret 40, and when in use, the string(s) of the instrument. Once a fret is in a desired position, a locking screw 31 fixes the position by passing through locking screw hole 30 and into rail 20 where it frictionally engages spine 44 of fret 40. One suitable non limiting example of an adjustment and or locking screw of interest is a machine screw or the like. Strings may then be passed over the adjustable fret assembly 10 such that the strings are positioned off the frets. From there, the instrument may be strung as one normally would set up such an instrument.

The instrument may be tuned in a normal fashion if desired. Also, one advantage of the inventive system is that the overall playability of the instrument may be selectively modified by engaging the adjustment screws to either move fret 40 closer to or further from rail 20. Adjustment of a plurality of frets collectively creates a geometry known as the "fret-plane." In other words, in use, moving frets 40 toward or away from the string, thereby selectively modifying the plane of the frets with respect to the longitudinal radius known as "relief," the curvature of which compensates for the string's oscillation, allows the strings to be an optimal distance from the fretboard without "buzzing," "rattling," or similar undesirable consequences. It will be appreciated that as the heights of the frets 40 are measurably adjusted relative to one another along the length of the neck, an optimal curvature or relief, can be achieved, as determined by the individual player allowing them to find the feel which is most appropriate for their playing style. In this manner, a nearly infinite range of "actions," meaning the overall relative heights of the strings from the frets may be achieved."

The instrument may be tuned in a normal fashion if desired. Also, one non limiting unique aspect of this disclosure is that the playability of the instrument may be selectively modified by engaging the adjustment screws to either move fret 40 closer to rail 20, or vice versa. In other words, in use, moving frets 40 toward or away from the string, thereby selectively modifying the geometry of the plane of the frets with respect to relief, or the longitudinal radius of the fretboard which compensates for the oscillation of each string.

For example, in one embodiment, the adjustment screws of some or all of frets 40 are adjusted in the same direction equally such that each of the frets is moved equidistance from rail 20 across the entire length of the neck body. However, it is also within the scope of this disclosure that the adjustment screws may be adjusted unequally, either in value or direction, such that each player may create the fret-plane geometry which is to his or her own liking in a non-destructive, semi-permanent manner With regard to material choices for the adjustable fret assembly 10, it will be appreciated that the bulk of the adjustable fret assembly 10 can be made of any suitably durable and hard material. Any variety of known metals, metal alloys, composites, bone, and suitable polymer-based materials are within the scope of this disclosure provided they have adequate properties. Also, there may be selective materials choices, either for the device entirely or at selective positions of the adjustable fret assembly. For example, those portions of the frets that contact the strings, such as fret crowns 48, may be made of a material that matches or compliments the string choice while the remaining assembly is constructed from another material. In this manner, a user may achieve a desired tonal modification, while keeping such things as cost or weight within acceptable parameters. The selection and arrangement of the material choice is another unique aspect of this disclosure and is not intended to be a limiting factor.

While various aspects of this disclosure have been illustrated and described, it will be appreciated that various changes can be made therein without departing from the spirit and scope of this disclosure. For example, without limitation, the frets 40 do not necessarily need to be substantially T-shaped. Other geometries may be used. Additionally, there may be more or fewer than the two screws (25 and 31) used to control movement of frets 40 relative to rail 20. Further, other variations and modifications apparent to those skilled in the art may be made within the nature of this disclosure.

Another embodiment is shown in FIGS. 11A through 15. Starting with FIGS. 11A and 11B, an alternate fret 40*a* is shown. In this embodiment fret 40*a* includes fret cap 48 as in the previous embodiment. Here, however, fret 40*a* is supported by a pair of inner support legs 44*a* and 44*b* placed near the middle of spine 42.

Figure 12:
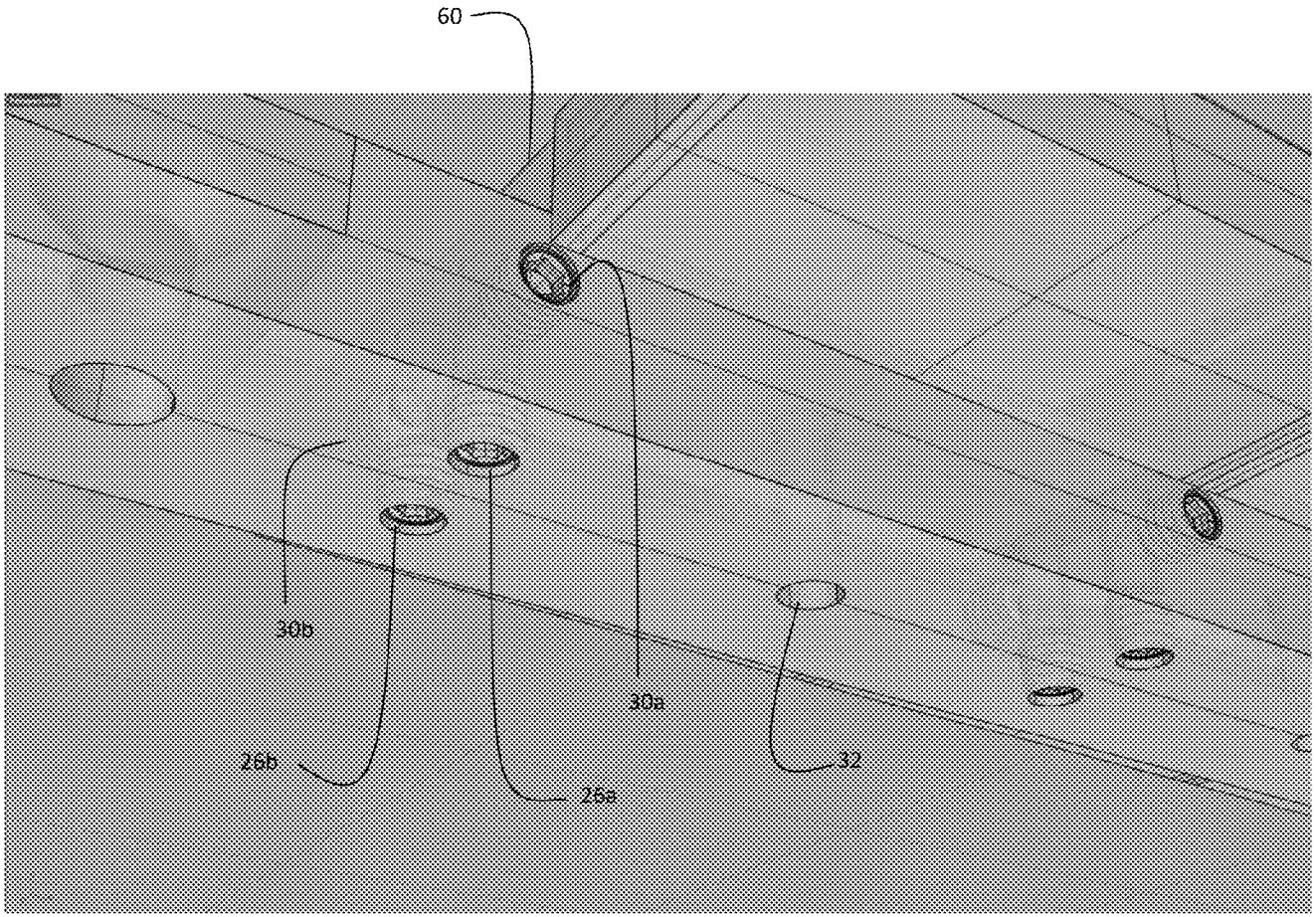
FIG. 12 is a perspective view of the bottom of the rail with the fret of the alternate embodiment of FIGS. 11A and 11B attached thereto.

As shown in FIG. 12, fret 40*a* is secured to rail 20 by a pair of receiving holes 26*a* and 26*b* which receive legs 44*a* and 44*b* respectively. Additionally, lock screws positioned within lock screw holes 30*a* and 30*b*, frictionally engages a portion of the support legs 44*a* and 44*b* in receiving holes 26*a* and 26*b* to prevent the movement thereof during use of the instrument.

Figure 13:
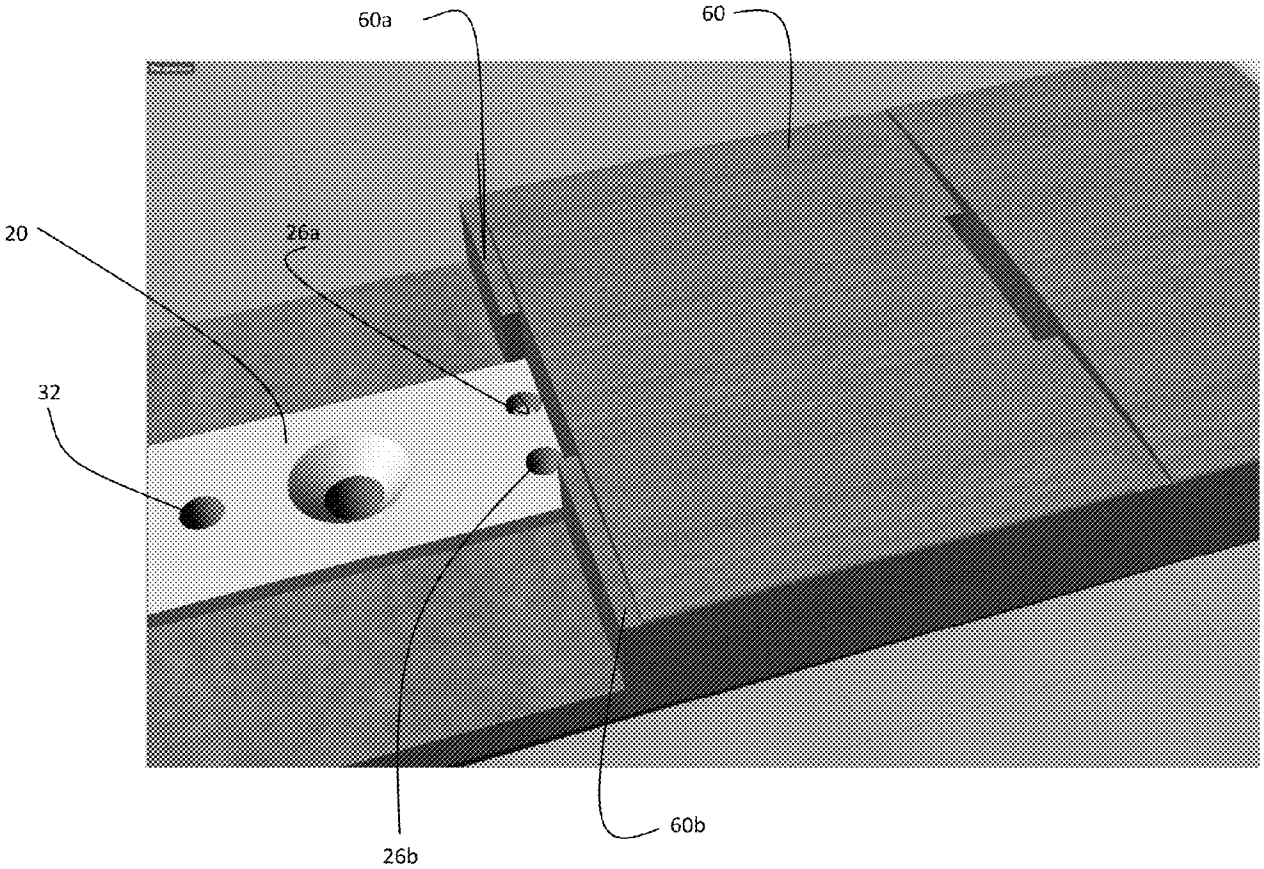
FIG. 13 is a perspective view of the attached spacer block of an alternate embodiment of FIGS. 11A and 11B whereby the spacer blocks extend to the edges of the neck/fretboard.

Referring now to FIG. 13, spacer blocks 60 are attached to rail 20 as in the previously embodiment. Here blocks 60 include rabbets 60*a* and 60*b* to support the ends of fret 40*a*.

Figure 14:
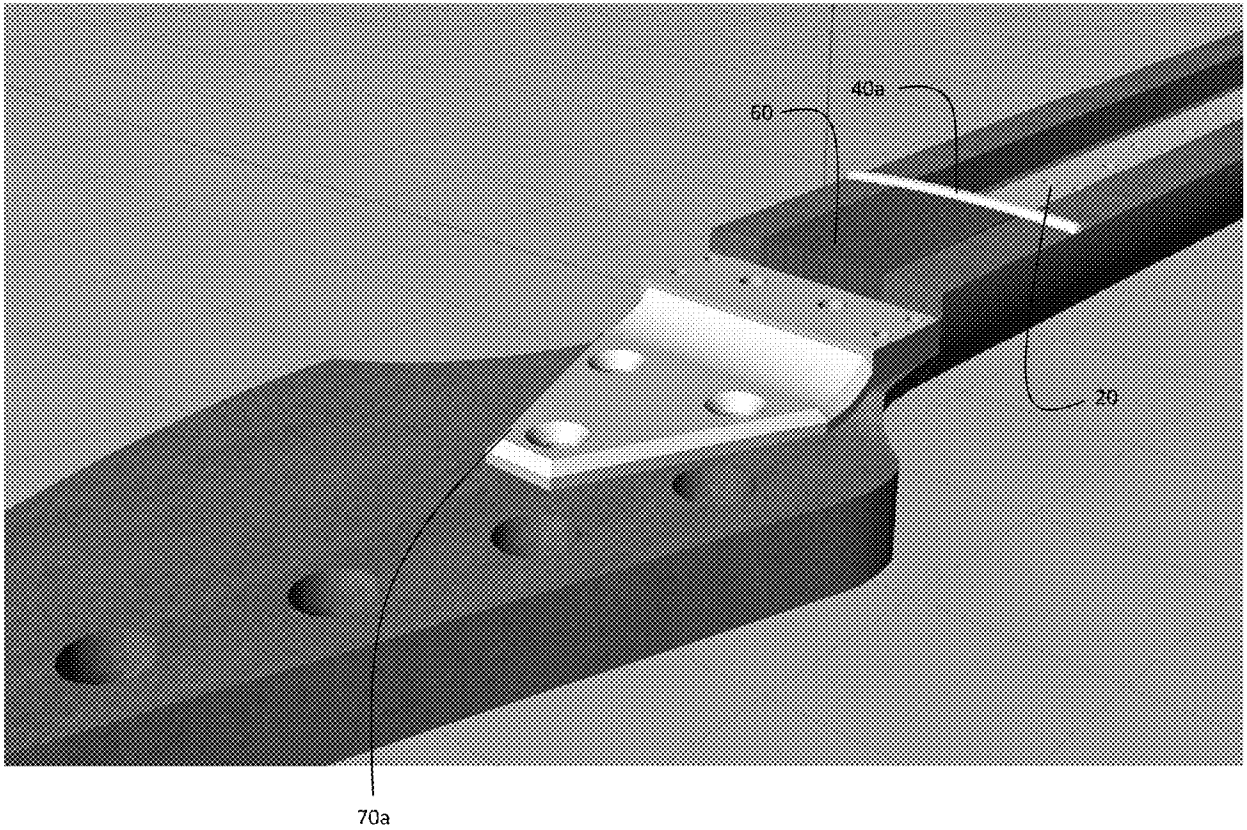
FIGS. 14 and 15 are perspective views of the nut platform and nut assembly of an alternate embodiment of the invention.
Figure 15:
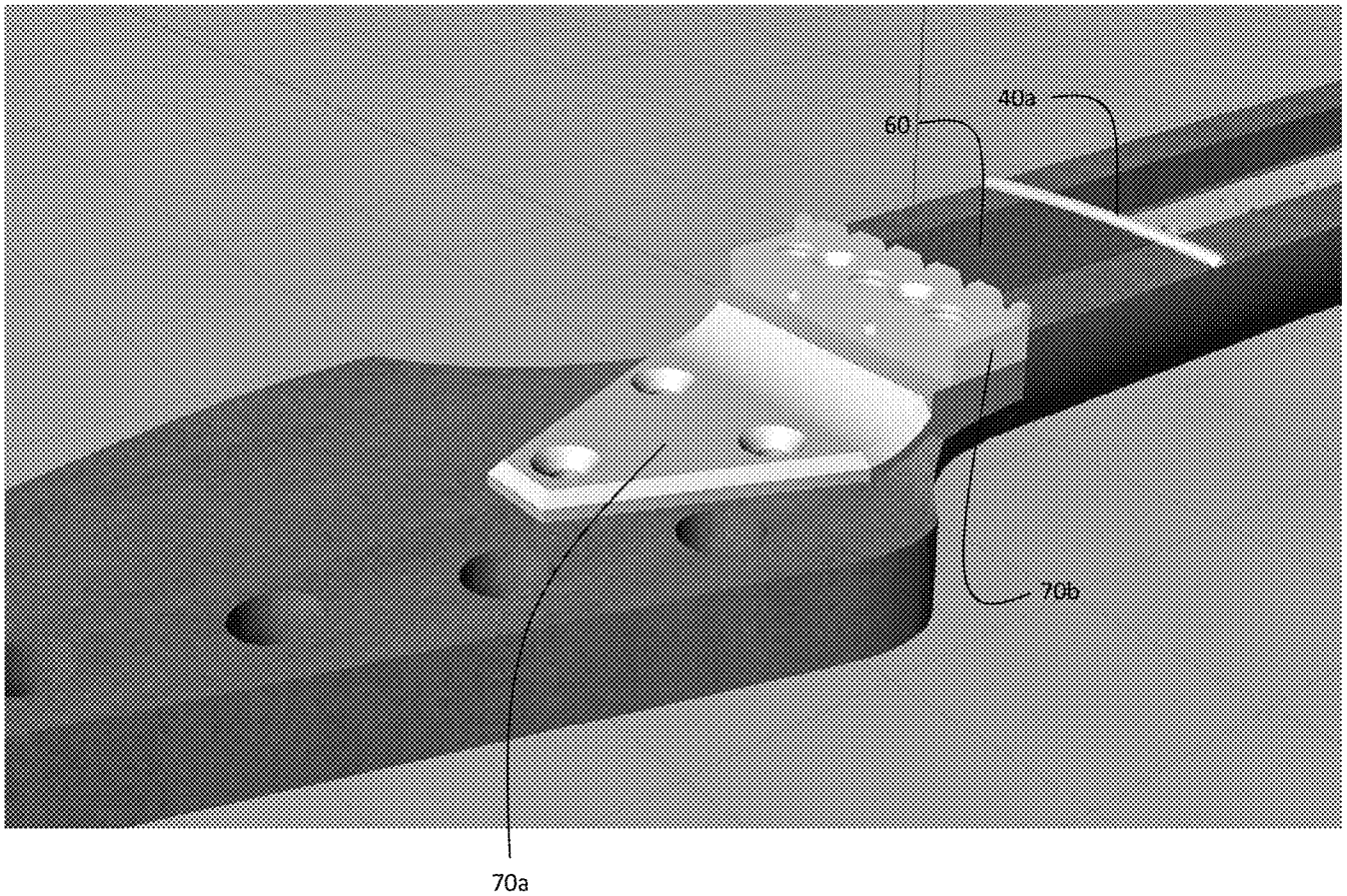

Rabbets 62*a* and 62*b* cut into the blocks 60*a*, shown in FIG. 14, also provide for terminating the fret 40*a* at the ends of the fretboard in a way that gives both a snag-free fret and smoother corners. By radiusing the edge of the corner transition on the fret the same as that of the blocks 60*a*, all edges simply disappear and nothing is felt but smooth curves on all sides. FIGS. 14 and 15 show an alternate arrangement for the nut assembly, comprising nut assembly base 70*a* and upper nut assembly 70*b*, in accordance with this alternate embodiment of the invention.

Figure 11A:
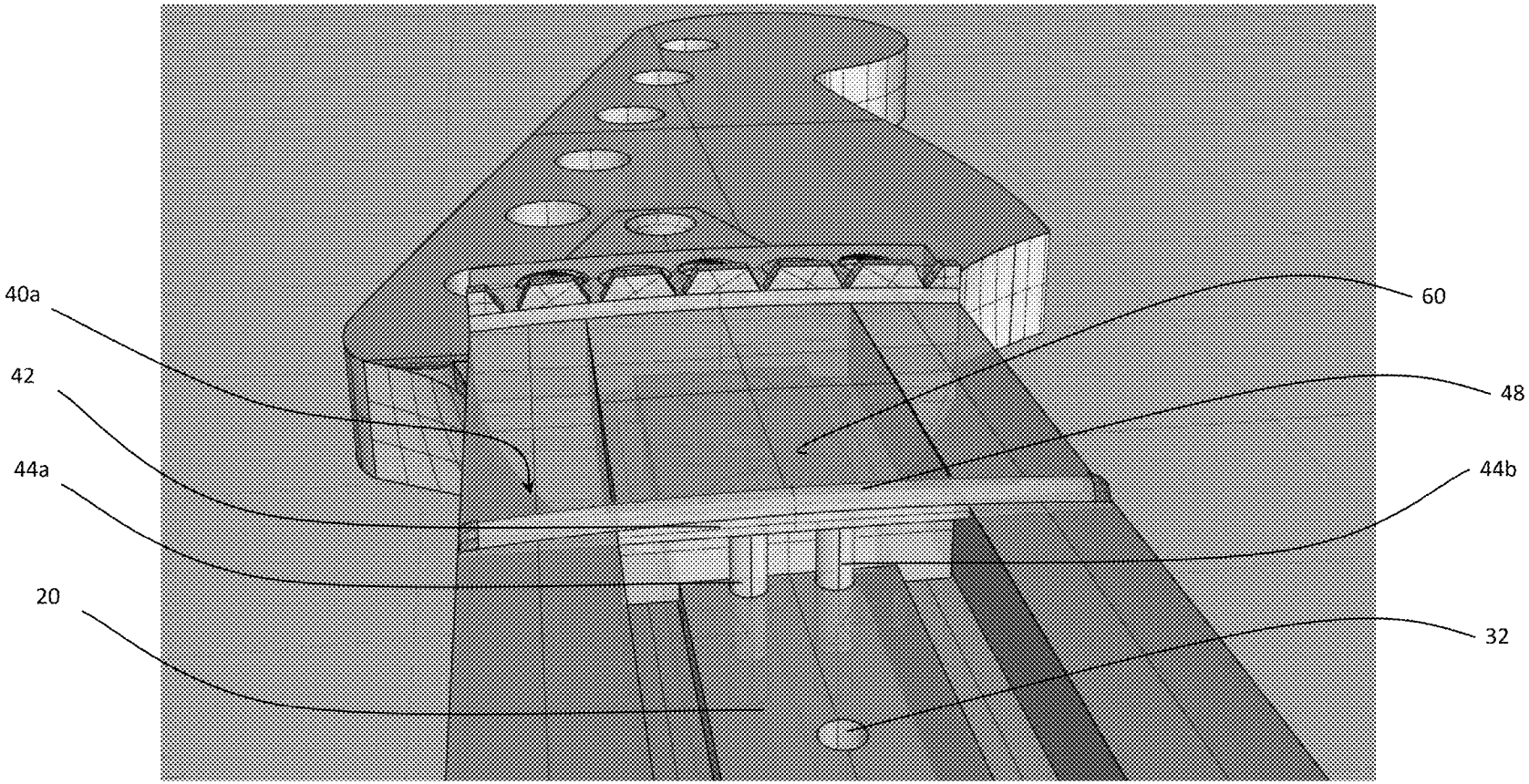
FIGS. 11A through 11C are perspective views of an alternate embodiment of the adjustable fret assembly showing a spacer block design that does not extend to the edges of the neck/fretboard.
Figure 11B:
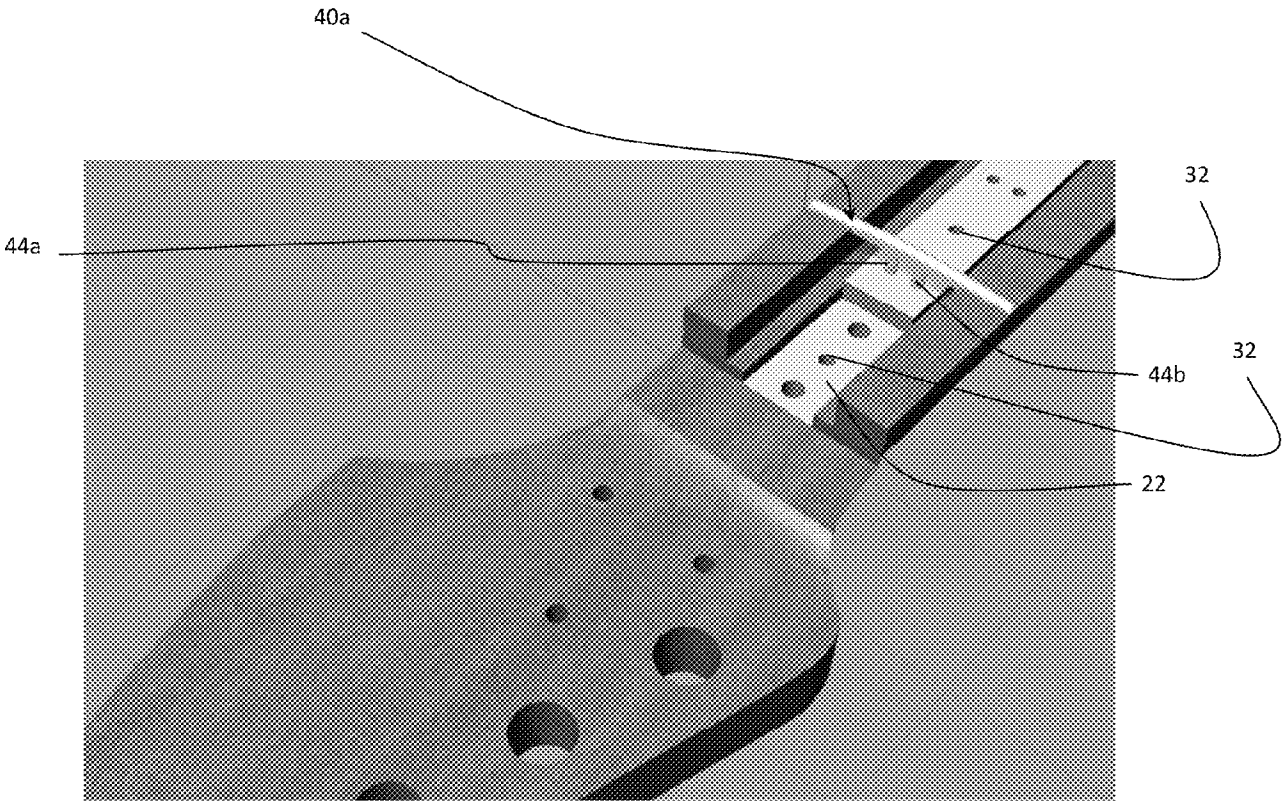
Figure 11C:
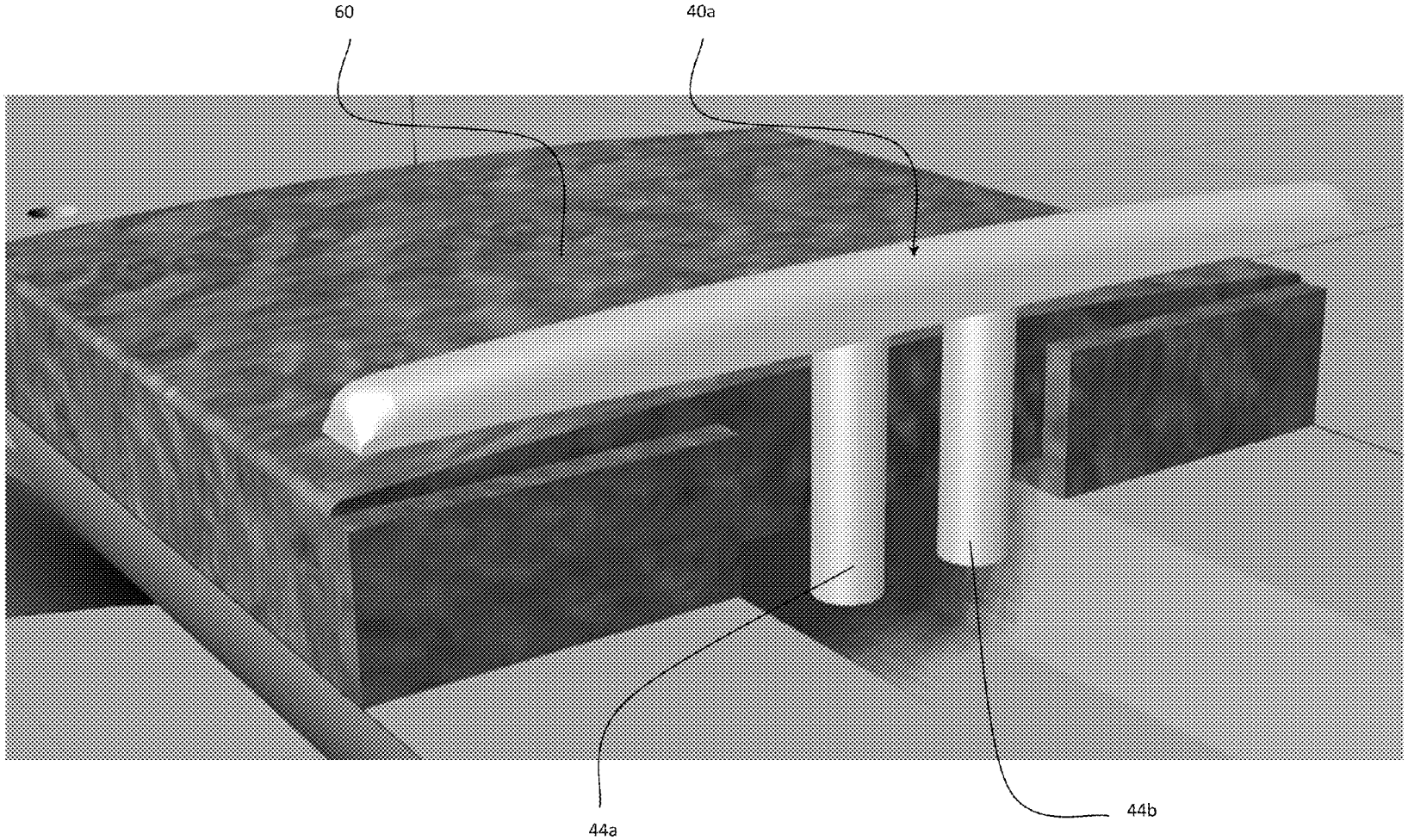

It can be appreciated from the figures that the spacer blocks of FIG. 13 extend to the edges of the fretboard/neck, whereas the spacer blocks of FIG. 11*a*, FIG. 14 and FIG. 15, do not extend to the edges of the neck/fretboard.

It will be seen that the advantages set forth above, and those made apparent from the foregoing description provide several objects and advantages over the prior art. These advantages include, but are not limited to modularity, adjustability, measurability and stability. While any one of these advantages provides a significant improvement over the prior, the synergistic effect of the individual elements described below will be evident. It is noted, however, that these objects and advantages are efficiently attained and since certain changes may be made in the above construction without departing from the scope of the invention, it is intended that all matters contained in the foregoing description or shown in the accompanying drawings shall be interpreted as illustrative and not in a limiting sense.

For example, the modularity of the inventive system allows all of the relevant components to be readily accessible. This allows the component parts to be taken apart and put back together with no loss of material or function. By means of one example, the removal of a fret from a traditional fretboard causes hidden, yet irreversible damage to the wood that cannot be denied. Moreover, removal of the fretboard or truss rod causes substantial damage to the wood structure. Modularity also means customization is now a real option. Changing the SpacerBlocks can give the instrument a new look, but can also offer the option of letting the user experiment with different feels, including fret heights (relative to the wood height), so as the user experiments with different looks and feels, the user can determine for themselves what is optimal and preferable without having to settle for the specifications dictated by the manufacturer.

The adjustability of the inventive system refers to the individual components, (i.e., the nut and frets) as well as the overall geometric result or "fret plane." The curved shape of the fret plane, termed 'relief' in the industry, is actually a complex geometrical shape. The ability to select the preferred relief in a fretboard means the end user is no longer limited to the choices of builders, luthiers, technicians and repairmen using material removal, wood bending and trial and error to determine the playability of the neck. In the event a problem with a fret, the inventive system provides a non-destructive solution.

Moreover, the inventive system allows for a level of measurability and consistency that has not been available. Here, measurability refers to the ability to put a precision measuring device, such as a digital caliper with tolerances in the 0.001" or 0.0001" range, around the top of a Fret and the bottom of the Rail, to determine a useful measurement which can be calculated to indicate incremental differences between adjacent frets. These measurements, when combined, determine the curved fret plane which compensates for the oscillation of the strings and gives the fretboard the desired low action, making it easier and faster to play. A caliper on a traditional neck is useless, as it cannot directly or accurately measure fret height differences. Measurability with fretboards of the prior art would require the use of a straight edge. Even so, the accuracy of the readings would not be reliable because of the multitude of variables, including the combination of tools, materials and design.

The stability provided by the inventive system results, first, from eliminating wood as a structural element in the design. In all previous cases, the frets, and therefore the fret plane, is dependent upon wood as the substrate for the overall geometry. Adding to that inherent instability; wood, under string tension, is bowed and then variously counter-tensioned internally with a metal tensioning device or "truss rod." This arrangement is inherently unstable because wood responds to changes in the environment in several ways, including temperature, humidity and barometric pressure. Even a ride in the trunk of a car in the hot sun can cause irreversible deformation due to changes in the water content within the cellular structure.

Furthermore, eliminating the wood as a structural element obviates the need for a truss rod. A less obvious instability occurs with regard to the frets. It may be better to use more rigid and durable metals, but such metals are more difficult with which to work on a slotted curved wood surface. The shape of the metal does not always match the shape of the wood accurately. Rigid metals are more difficult to install and make conform to the fretboard's curved slots. Traditional fret manufacturers know soft-metal frets will wear down fast in the areas where the musician plays the most. This is accepted and viewed as future income, rather than a design flaw. Additionally, smaller frets wear down faster than bigger frets. This contributes to the instability of the traditional fretboard design. Accordingly, the frets of the inventive system, regardless of their size or shape, are not directly dependent upon the structural integrity of the wood. This allows harder metals as a viable option, resulting in a more stable, and durable fret plane and therefore a better-playing instrument.

It is also to be understood that the following claims are intended to cover all of the generic and specific features of the invention herein described, and all statements of the scope of the invention which, as a matter of language, might be said to fall there between. Relative terminology, such as "substantially" or "about," describe the specified materials, steps, parameters or ranges as well as those that do not materially affect the basic and novel characteristics of the claimed inventions as whole (as would be appreciated by one of ordinary skill in the art). Now that the invention has been described,

What is claimed is:

1. A removable fret assembly for a fretted stringed musical instrument comprising:

a. an elongated rail having a first end and a second end as well as an upper surface and a lower surface;

b. a first plurality of paired-bores extending from the upper surface of the rail to the lower surface;

c. at least one fret having a longitudinal body and at least one support leg depending therefrom and movably disposed within at least one of the first plurality of paired-bores on the upper surface of the rail;

d. at least one mechanical adjustment device movably disposed within at least one of the first plurality of paired-bores on the lower surface of the rail in contact with at least one of the support legs of the at least one fret;

e. at least one bore disposed in a side of the rail extending inward and in communication with at least one of the first plurality of paired-bores; and f. a mechanical locking device movably disposed within the at least one of the paired-bores on the side of the rail in releasable contact with at least one of the support legs of the at least one fret;

g. wherein movement of the mechanical adjustment device causes the at least one fret to move in distal relation to the rail;

h. wherein the spacer has a rabbet along at least one end thereof to receive at least a portion of the at least one fret.

2. The fret assembly of claim 1, further comprising:

a. a second plurality of bores extending from the upper surface of the rail to the lower surface, each of the bores in the second plurality being positioned between the paired-bores in the first plurality; and b. a spacer connected to the rail by a mechanical fastener extending through the rail.

3. The fret assembly of claim 1, wherein the first plurality of paired-bores have predefined geometry on the upper surface of the rail that matches a predefined geometry of the support legs on the at least one fret.

4. The fret assembly of claim 1 wherein the elongated rail further comprises a recess at the first end thereof.

5. The fret assembly of claim 1, further comprising:

a. a nut platform assembly, having a head portion and a neck portion;

b. wherein the neck portion of the nut assembly is mechanically fixed to the recess at the first end of the rail.

6. The fret assembly of claim 5 wherein the head portion of the nut assembly is affixed to a head of the stringed instrument by a mechanical fastener.

* * * * *